United States Patent [19]

Gillis, Jr.

[11] Patent Number: 4,531,443

[45] Date of Patent: Jul. 30, 1985

[54] PERCUSSION STICK HOLDER

[76] Inventor: Richard P. Gillis, Jr., 332 Kingswood, El Paso, Tex. 79932

[21] Appl. No.: 659,178

[22] Filed: Oct. 9, 1984

[51] Int. Cl.[3] ..... G10G 7/00

[52] U.S. Cl. ..... 84/329; 84/421; 211/111; 248/122; 248/296; 248/314

[58] Field of Search ..... 84/329, 421, 422; 211/111; 248/122, 296, 314

[56] References Cited

U.S. PATENT DOCUMENTS 3,128,664 4/1964 Bango ..... 84/329

3,273,846 9/1966 De Mare ..... 248/314

*Primary Examiner*—Lawrence R. Franklin

*Attorney, Agent, or Firm*—Richards, Harris, Medlock & Andrews

[57] ABSTRACT

A percussion stick holder assembly is provided, having at least two tubes (12) held in a parallel, spaced apart relationship by a support plate (16). A spring clamp (18) is provided for gripping a percussion unit stand and is rotatably secured to plate (16). Percussion sticks may thus be conveniently provided for the user in a position for quick and accurate grasping for removal, use and return.

3 Claims, 2 Drawing Figures

FIG. 1
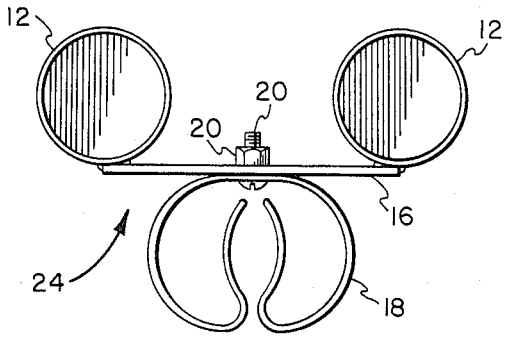
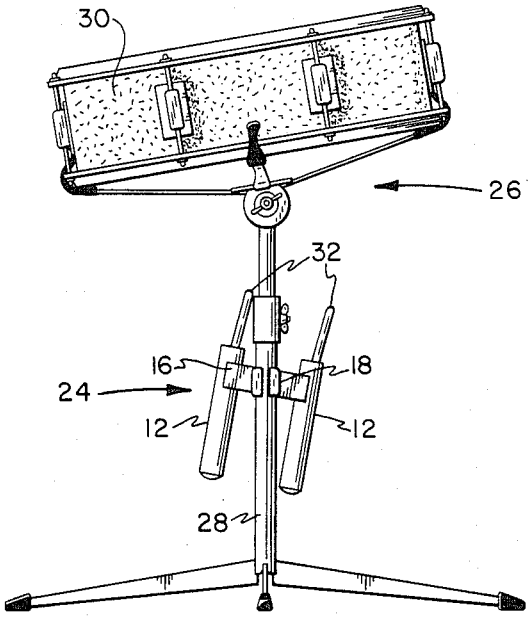
FIG. 2

PERCUSSION STICK HOLDER

TECHNICAL FIELD

This invention relates to musical accessories and more particularly relates to percussion equipment organizers.

BACKGROUND OF THE INVENTION

A percussionist in a modern band or orchestra is frequently required to manipulate a variety of devices for sound effects. Many of the devices require special sticks or beaters. In the course of a performance, the percussionist may have to change the sticks or beaters several times.

Activity in the percussion section can occur at a fast pace when the sticks or beaters are being exchanged. The percussionist should be able to accurately locate the correct sticks and to grasp them for playing while maintaining the rhythm of performance. Tray-like stick holders are available, but the trays permit the sticks and beaters to comingle. Further, even when the correct pair of sticks is located, they cannot generally be individually grasped, but must be removed from the tray and then separated for use.

These and other disadvantages of the prior art are overcome by the present invention wherein an improved holder for percussion sticks and beaters is provided.

DISCLOSURE OF THE INVENTION

A holder is provided for maintaining percussion sticks and beaters about an instrument stand. At least two tubes are provided for accepting the sticks or beaters. The tubes are held in a generally spaced apart and parallel relationship by an interconnecting plate. A gripper is attached to the plate for rotatingly securing the holder tubes to the instrument stand.

In a preferred embodiment of the present invention, the tubes are spaced apart to permit individual access to the sticks therein. The gripper is preferably a spring clamp.

These and other features and advantages of the present invention will become apparent from the following detailed description, wherein reference is made to the figures in the accompanying drawing.

BRIEF DESCRIPTION OF THE DRAWINGS

FIG. 1 is a top view of one embodiment of the present invention.

FIG. 2 is a pictorial illustration of the embodiment shown in FIG. 1 attached to a percussion instrument.

DETAILED DESCRIPTION

Referring now to FIG. 1, there may be seen a top view of a preferred embodiment of the present invention. A pair of tubes 12 are supported by plate 16. A gripper device 18 is fastened to plate 16 for use in securing the assembly adjacent a percussion instrument.

Tubes 12 are generally sized to accomodate the handles of the percussion sticks and beaters (hereinafter "sticks") used by the percussionist. Sticks are generally used in pairs, so at least two tubes are provided. Additional tubes could, however, be provided according to the present invention to present a full array of sticks to the player. Tubes 12 are closed at the bottom end to support the sticks.

Plate 16 is provided to support tubes 12 and may be fastened to tubes 12 in any convenient manner, although welding or brazing is preferred. Tubes 12 are generally held in a parallel relationship and spaced apart a distance effective for individual access to the sticks held by tubes 12. Then, the sticks can be removed in a ready-to-use position.

Gripper device 18 is fastened to plate 16 for attaching the assembly at a selected location within the percussion unit. Fastener 20 may simply be a bolt and nut assembly, where the relative angle between tubes 12 and gripper 18 can be adjusted to suit the player and then secured against further rotation. Gripper device 18 may be any convenient clamping device, such as a set screw or spring clamp. A preferred gripper device 18 is a spring clamp, which may be generally "C"-shaped, where an opening is spread about a generally tubular shape and resilient spring forces act to close the opening to force interior surfaces of gripper 18 into contact with the surface being gripped.

Referring now to FIG. 2, there is shown a pictorial illustration of a percussion stick holder as shown in FIG. 1 mounted adjacent a percussion unit 30. Stick holder assembly 24 is attached to stand 28, preferably to a tubular upright member, by spring clamp 18. Tubes 12 are held in a spaced, parallel relationship by plate 16 for accepting sticks 32.

Sticks 32 may be located within an assembly 26 of percussion devices 30 and placed at a location and angle determined by the player. The angle is adjustable for a variety of locations within assembly 26 and may be secured once a comfortable angle is found. Spring clamp 18 permits easy attachment and removal of the assembly to stand 28.

In a preferred stick holder assembly, tubes 12 are about one inch (1") in diameter and six inches (6") long and closed at one end by removable end plugs. Gripper device 18 is a #225 HL (GT) Gripper Clip available from Gibson Good Tools, Inc., Grottoes, Va. Bolt assembly 20 may conveniently include a locknut with nylon bushing for secure fastening.

As many possible embodiments may be made of this invention without departing from the spirit or scope thereof, it is to be understood that all matters herein set forth in the accompanying drawings are to be interpreted as illustrative and not in any limiting sense.

What is claimed is:

1. Apparatus for holding percussion sticks on an instrument stand, comprising:

at least two tubes each having a first open end for accepting one of said percussion sticks and a second closed end;

means for holding said at least two tubes in parallel spaced apart relationship;

a gripper effective to removingly engage said instrument stand; and fastener means for rotationally securing said gripper to said plate means.

2. Apparatus according to claim 1, wherein said spaced apart relationship is effective to enable independent grasping and manipulation of said percussion sticks in each of said tubes.

3. Apparatus according to claim 1, wherein said gripper is a spring clamp.

* * * * *